US009593399B2

(12) United States Patent
Jamwal et al.

(10) Patent No.: US 9,593,399 B2
(45) Date of Patent: Mar. 14, 2017

(54) PROCESS FOR MAKING COLD-ROLLED DUAL PHASE STEEL SHEET

(71) Applicant: THYSSENKRUPP STEEL USA, LLC, Calvert, AL (US)

(72) Inventors: Ranbir Singh Jamwal, Mobile, AL (US); Joseph Frimpong, Saraland, AL (US); Bertram Wilhelm Ehrhardt, Mobile, AL (US); Harald Van Bracht, Theodore, AL (US); Roger Dale Boggs, Columbus, MS (US); Stanley Wayne Bevans, S.W. Decatur, AL (US)

(73) Assignee: Thyssenkrupp Steel USA, LLC, Calvert, AL (US)

( * ) Notice: Subject to any disclaimer, the term of this patent is extended or adjusted under 35 U.S.C. 154(b) by 496 days.

(21) Appl. No.: 14/105,388

(22) Filed: Dec. 13, 2013

(65) Prior Publication Data

US 2014/0166163 A1 Jun. 19, 2014

Related U.S. Application Data

(60) Provisional application No. 61/736,752, filed on Dec. 13, 2012.

(51) Int. Cl.
*C21D 8/02* (2006.01)
*C22C 38/58* (2006.01)
(Continued)

(52) U.S. Cl.
CPC ..... *C22C 38/58* (2013.01); *C21D 8/0226* (2013.01); *C21D 8/0263* (2013.01); *C21D 9/48* (2013.01);
(Continued)

(58) Field of Classification Search
CPC ..... C21D 8/02; C21D 8/0205; C21D 8/0226; C21D 8/0236
(Continued)

(56) References Cited

U.S. PATENT DOCUMENTS 6,743,307 B1 6/2004 Engl et al.
7,927,433 B2 4/2011 Tomida et al.
(Continued)

FOREIGN PATENT DOCUMENTS

EP 1118687 A1 7/2001
EP 2098600 A1 9/2009

OTHER PUBLICATIONS

International Search Report dated Feb. 28, 2014 for International Application No. PCT/US13/074874, 2 pages.

*Primary Examiner* — Brian Walck
(74) *Attorney, Agent, or Firm* — Dinsmore & Shohl LLP

(57) ABSTRACT

A process for manufacturing a cold rolled high strength dual phase steel. The process includes soaking a steel slab within a temperature range of 1200-1300° C., hot rolling the soaked steel slab in a roughing treatment and producing a transfer bar, and hot rolling the transfer bar in a finishing treatment and producing hot rolled strip. The hot rolled strip is cold rolled with at least a 55% reduction in thickness. The cold rolled sheet is intercritically annealed at a temperature between 790-840° C. and rapidly cooled to a temperature between 450-500° C. The rapidly cooled sheet has a ferrite plus martensite microstructure, a 0.2% yield strength of at least 550 MPa, a tensile strength of at least 980 MPa and a total elongation to failure of at least 10%.

17 Claims, 2 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 9/48*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
USPC ..... 148/330, 333–335, 603, 651, 652
See application file for complete search history.

(56) References Cited

U.S. PATENT DOCUMENTS

2009/0071574 A1* 3/2009 Sun ..... C22C 38/002
148/537
2010/0000634 A1 1/2010 Spehr et al.

* cited by examiner

PROCESS FOR MAKING COLD-ROLLED DUAL PHASE STEEL SHEET

RELATED APPLICATION

This application claims priority to U.S. Provisional Patent Application Ser. No. 61/736,752 filed on Dec. 13, 2012, which is incorporated in its entirety herein by reference.

BACKGROUND OF THE INVENTION

Low-carbon steels having a yield strength of approximately 170 megapascals (MPa) and excellent deep drawing ability are used in a variety of industries, e.g. the automobile industry. However, despite their forming and cost advantages over high-strength steels, the relatively low-strength level results in the crash performance of such materials being mainly dependent on a thickness of a sheet thereof. As such, 1$^{st}$ generation advanced high-strength steels (AHSS) have been developed in order to reduce the weight of automotive components and thus afford for improved vehicle fuel efficiency.

Among the 1$^{st}$ generation AHSS, dual phase steels are increasingly being used in the vehicle components for "lightweighting" of automobiles. The excellent strength-ductility balance gives a large formability range for comparable high tensile strength HSLA steels and thus make them one of the most attractive choices for automobile weight reduction. Further optimization of material designs requires automobile manufacturers opting for AHSS grades from the higher end of the spectra in terms of tensile strength where dual phase steels are an able choice for incorporation in the current assemblies. In particular dual phase steels can be produced by subjecting low-carbon steels to an intercritical anneal followed by sufficiently rapid cooling. It is appreciated that an intercritical anneal refers to annealing the steel at a temperature or temperature range below the materials Ac3 temperature and above the Ac1 temperature where the microstructure consists of ferrite and austenite, thereby affording for the rapid cooling to transform the austenite into martensite such that a predominantly dual phase ferrite-martensite microstructure is produced.

It is known in the art that alloying elements such as manganese, chromium, molybdenum, and vanadium can be used to reduce the rate of cooling required for the transformation of the austenite to martensite. For example, Mo has been an effective alloying element, especially for coated sheets, for imparting quench hardenability. Molybdenum additions also have the added benefit of not being prone to selective oxidation during annealing—as compared to Cr, Mn, and Si—and thus not hampering surface characteristics of coated dual phase steels. The added alloying elements circumvent the requirement of high cooling rates on a production line to obtain martensite as a low temperature transformation product in a ferritic matrix. The alloying elements become more consequential in the case of dual phase steels having tensile strength above 980 MPa which require high volume fractions of the hard phase martensite. However, the addition of such alloying elements, with Mo being most expensive, naturally increases the cost of the steel.

Three basic methods are known for the commercial production of dual phase steels. First, an as-hot-rolled method produces the dual phase microstructure during conventional hot-rolling through the control of chemistry and processing conditions. Second, a continuous annealing approach typically takes coiled hot or cold rolled steel strip, uncoils and anneals the steel strip in an intercritical temperature range in order to produce a ferrite plus austenite microstructure/matrix. Thereafter, sufficiently rapid cooling higher than the critical cooling rate for the steel chemistry is applied to the strip to produce the ferrite-martensite microstructure. Finally, the third method batch anneals hot or cold rolled material in the coiled condition.

The temperature or temperature range of the intercritical anneal is important since for a given alloy composition the intercritical anneal temperature controls or determines the amount of austenite, and its carbon content, that can be transformed to martensite.

SUMMARY OF THE INVENTION

The instant invention employs using ultra fine cold rolled starting microstructures subjected to specific annealing temperatures that fit well within regular production cycles, followed by specific cooling strategies to obtain cold rolled dual phase steels with a low YS/TS ratio for the 980 MPa and above dual phase steel product class. The use of a stated annealing temperature range is coupled with a fine ferrite and bainite (with pearlite) starting cold rolled microstructure that allows the use of an annealing cycle disclosed herein. The fine bainite starting structure aids to the formation of the final dual phase structure with ideal high strength and ductility balance. In particular, the invention makes use of specific cooling strategies using gas jet rapid cooling and utilizing therein 'Ultra Rapid Cooling' (URC) to obtain ultra high strength>980 MPa TS cold rolled dual phase steels.

A process for manufacturing a cold rolled high strength dual phase steel is provided. The process includes providing a steel slab having a chemical composition in weight percent within a range of 0.12-0.16 carbon (C), 1.6-2.0 manganese (Mn), 0.4 maximum (max) silicon (Si), 0.2-0.5 chromium (Cr), 0.010 max niobium (Nb), 0.030-0.080 titanium (Ti), 0.02 max vanadium (V), 0.04-0.10 molybdenum (Mo), 0.1 max nickel (Ni), 0.0040 max sulfur (S), 0.015 max phosphorous (P), 0.0060 max nitrogen (N), 0.0004-0.0030 boron (B), 0.02-0.05 aluminum (Al), 0.004 max calcium (Ca), balance iron (Fe) and incidental melting impurities known to those skilled in the art. Thereafter, the steel slab is soaked, e.g. within a soaking furnace, within a temperature range of 1200-1300° C., and then hot rolled in a roughing treatment in order to produce a transfer bar.

The process also includes hot rolling the transfer bar in a finishing treatment and producing hot rolled strip. The finishing treatment has an entry temperature between 1040-1120° C. and an exit temperature between 900-970° C. ° C. The hot rolled strip is cooled to a coiling temperature between 540-620° C. prior to cooling. In some instances, the hot rolled strip has a thickness between 2.5-5.5 mm, and is cooled to the coiling temperature using a cooling rate between 15-40° C./sec. The cooling strategy employed at the laminar cooling section of the hot strip mill ensures a fine hot rolled starting structure consisting of ferrite-bainite (and also pearlite) going downstream along the length and width of the strip.

The hot rolled strip is cold rolled to produce cold rolled sheet. The cold rolled sheet has at least a 55% reduction in thickness compared to the hot rolled strip thickness. Also, the cold rolled sheet is subjected to an intercritical anneal at a temperature between 790-840° C., followed by rapid gas jet cooling or in particular ultra rapid cooling (URC) to a temperature between 450-500° C. In some instances, the cold rolled sheet is subjected to the intercritical anneal for a time period of between 60-90 seconds. In addition, the intercritically annealed cold rolled sheet has a maximum thickness of 2.3 mm, a ferrite plus martensite microstructure and a grain size of ASTM 10 or less, e.g. an ASTM grain size of 12 or less.

In a preferred embodiment, the intercritically annealed and rapidly cooled cold rolled sheet has a 0.2% yield strength above 550 MPa, and a tensile strength of at least 980 MPa. In addition, the cold rolled sheet has a total percent elongation to failure of at least 10%. The cold rolled sheet can also exhibit a work hardening exponent 'n' of at least 0.06 and a yield strength to tensile strength ratio (YS/TS) between 0.4-0.7. The cold rolled sheet can further be subjected to a bake hardening treatment, the bake hardened cold rolled sheet exhibiting an increase in yield strength of at least 30 MPa.

A cold rolled dual phase steel is also provided, the steel having a chemical composition and mechanical properties disclosed above.

DETAILED DESCRIPTION OF THE INVENTION

A process for producing a cold-rolled dual-phase steel having a microstructure of ferrite plus martensite showing a low YS/TS ratio for a 980 MPa and above tensile strength product class is provided. As such, the invention has utility as a process for making steel sheet that can be used for manufacturing parts, components, etc.

The process includes producing cold-rolled low-carbon steel sheet and subjecting the steel sheet to an intercritical anneal within a continuous annealing line (CAL). Thereafter, the material is subjected to a rapid cooling treatment. In this manner, a dual-phase steel having a 0.2% yield strength of at least 550 MPa, a tensile strength of at least 980 MPa, and a total percent elongation of at least 10% is provided. In addition, a press formed and painted part of the material exhibits an increase in strength of at least 30 MPa upon bake hardening.

In a preferred embodiment, a steel slab having a chemical alloy composition within the range of range of 0.12-0.16 weight percent C, 1.6-2.0 Mn, 0.4 max Si, 0.2-0.5 Cr, 0.010 max Nb, 0.030-0.080 Ti, 0.02 max V, 0.04-0.10 Mo, 0.1 max Ni, 0.0040 max S, 0.015 max P, 0.0060 max N, 0.0004-0.0030 B, 0.02-0.05 Al and 0.004 max Ca with the balance Fe and unavoidable tramp and residual elements is subjected to the inventive process disclosed herein.

Figure 1:
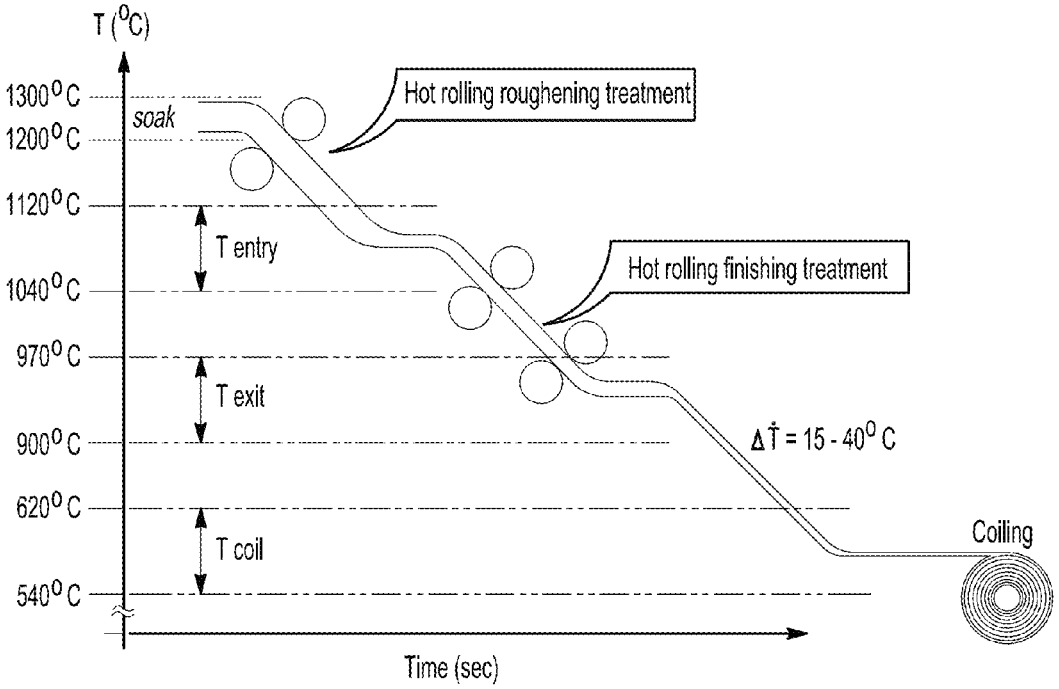
FIG. 1 is a graphical plot/illustration of a temperature-time profile that produces a hot rolled strip steel according to an embodiment of the present invention.
Figure 2:
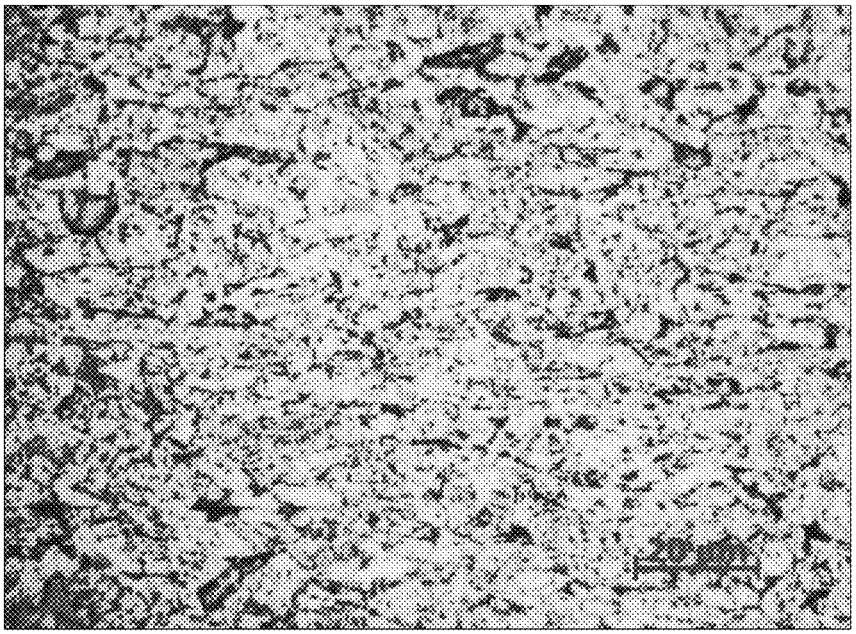
FIG. 2 is an optical micrograph at 1000× of a fine ferrite-bainite (some pearlite) hot rolled microstructure obtained at room temperature.

Referring to FIG. 1, a slab of steel having a chemical composition within the above-stated range is soaked at an elevated temperature, e.g. between 1200-1300° C., to ensure that most if not all of the alloying elements are in solid solution. The slab is then subjected to a roughing treatment and/or a finishing treatment to produce a hot strip coil having a thickness between 2.5 and 5.5 millimeters (mm). The finishing treatment can have an entry temperature between 1040-1120° C. and an exit temperature between 900-970° C. In addition, the hot strip coil can be cooled after the finishing treatment at a cooling rate between 15-40° C./sec before being coiled at a temperature or temperature range between 540-620° C. As shown in FIG. 2, a fine hot band microstructure of ferrite and bainite/pearlite going downstream is provided.

Figure 3:
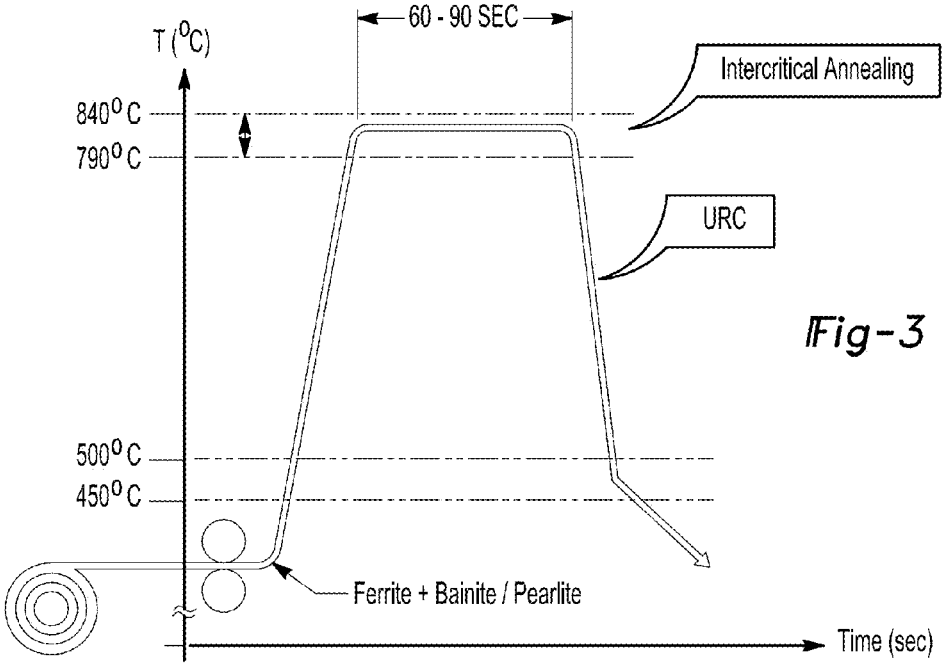
FIG. 3 is a graphical plot/illustration of a temperature-time profile for intercritical annealing and ultra rapid cooling that produces a cold-rolled dual-phase steel according to an embodiment of the present invention.

The hot strip coil is then subjected to cold-rolling with at least a 55% reduction in thickness of the strip followed by intercritical annealing in a CAL. The annealing temperature is between 790-840° C. with an annealing time between 60-90 seconds. After subjecting the cold-rolled sheet to the intercritical annealing treatment, the sheet is rapidly cooled and/or ultra rapidly cooled using the URC to a temperature between 450-500° C. For the purposes of the instant application, URC is defined as rapidly cooling with a maximum cooling rate capacity of 83 K/sec, for example by using adjustable plenum positions that afford for cooling fans to be moved closer to a passing steel strip in a cooling tower. In addition, the URC can have or include added cooling capacity available by hydrogen injection into the gas ranging from 0.1%-15%, with an optimum usage of 2-2.5% hydrogen. Also, it is appreciated that the URC "gas" can be air, nitrogen, air enriched with excess nitrogen, etc. For example and for illustrative purposes only, FIG. 3 is a graph of time versus temperature for an embodiment where cold-rolled strip is intercritically annealed 790-840° C. followed by rapid gas jet cooling and/or ultra rapid cooled using the URC to 450-500° C.

Figure 4:
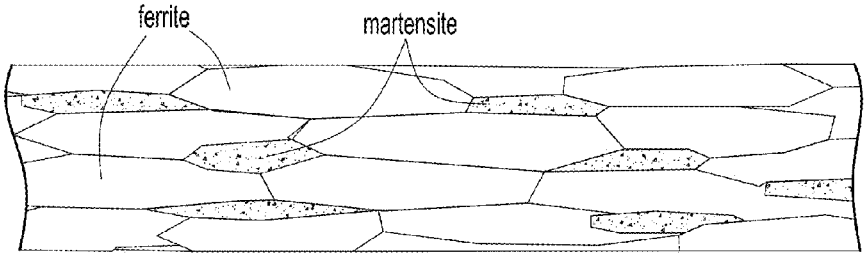
FIG. 4 is a schematic illustration of a ferrite-martensite microstructure for a cold rolled dual phase steel produced according to an embodiment of the present invention.

The cold-rolled steel sheet so obtained has a dual phase ferrite-martensite microstructure as illustratively shown in FIG. 4. In addition, the thickness of the cold-rolled sheet is a maximum of 2.3 millimeters and possesses good weldability. The steel sheet has a 0.2% yield strength above 550 MPa, a tensile strength of at least 980 MPa and a total percent elongation of at least 10%. In addition, the steel sheet can have a work hardening exponent 'n' of at least 0.06 and bake hardening of the material, e.g. subjecting the material to an elevated temperature of approximately 170° C. for 20 minutes, provides an increase in strength of at least 30 MPa.

For the purposes of the present invention, the n-value is defined by the expression of the form $\sigma=K\epsilon_n$ where for an induced strain c, the corresponding stress a is the new yield strength of the material caused by the degree of cold working that has induced the strain E. As such, and not being bound by theory, the greater the value of n for a material, the greater the degree of work hardening the material exhibits upon cold forming and thus giving a measure of increased global formability.

In order to provide a specific teaching of the invention and yet not limit the scope thereof in any way, an example of a process according to an embodiment is provided below.

Example

Steel slabs of low carbon low alloy steel having a nominal composition within the range disclosed above and a thickness of approximately 255 millimeters was soaked between 1235-1270° C., and then subjected to a roughing treatment to produce a transfer bar. Thereafter, the transfer bar was subjected to a finishing treatment with an entry temperature of 1090° C. and an exit temperature of 950° C. in order to produce hot rolled strip with a thickness between 2.5 and 5.5 millimeters (mm). The hot rolled strip was then cooled at 20° C./S to 560° C. before being coiled.

The coiled hot strip was cold-rolled to produce a 55% reduction in thickness, followed by intercritical annealing on a CAL between 810-830° C. for 60-90 seconds. Thereafter, the steel strip was rapidly cooled using rapid gas jet cooling to between 480-500° C. before being re-coiled.

Figure 5:
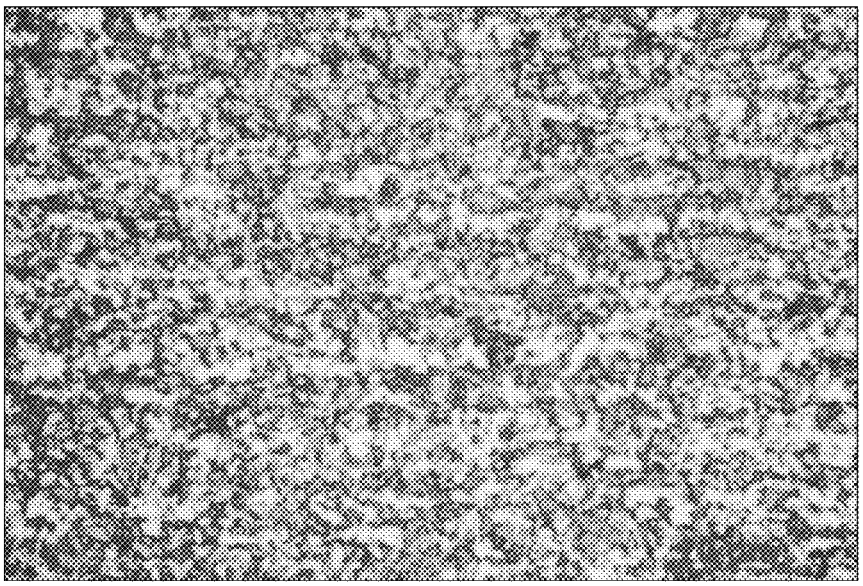
FIG. 5 is an optical micrograph at 1000× of a dual phase structure obtained at room temperature using rapid gas jet cooling with black etched regions showing martensite and white etched regions showing ferrite.

The microstructure of the cold rolled steel sheet had a grain size of ASTM 13 and was dual phase with a high volume fraction (>40%) of low transformation product-martensite. FIG. 5 shows an optical micrograph at 1000× of the cold rolled steel sheet with black etched regions being martensite and white regions being ferrite. In addition, random test samples taken from the cold rolled steel sheet had the chemistries shown in Table 1, thereby confirming the material had a chemistry range within the stated embodiment.

Table 2 provides mechanical data for the cold rolled steel sheet having a thickness between 1.4-1.7 mm. As shown in the table, the material exhibited 0.2% yield strength values above 550 MPa, tensile strength values greater than 980 MPa and total elongation values of at least 10%. The yield strength to tensile strength ratio was less than 0.70 and the work hardening exponent 'n' for the material was at least 0.06. The steel sheet was also subjected to a bake hardening treatment with an increase in strength for the material being at least 30 MPa.

TABLE 1

| Chemistry Check | C | Si | Mn | P | Al | N | Ni | Cr | Mo | Ti |
|---|---|---|---|---|---|---|---|---|---|---|
| 1 | 0.159 | 0.339 | 1.871 | 0.0095 | 0.0411 | 0.0065 | 0.033 | 0.424 | 0.050 | 0.042 |
| 2 | 0.160 | 0.344 | 1.870 | 0.0091 | 0.0403 | 0.0064 | 0.029 | 0.421 | 0.051 | 0.042 |

TABLE 2

| | Avg. Head | | | | Avg. Tail | | | |
|---|---|---|---|---|---|---|---|---|
| Annealing | 0.2% YS (MPa) | TS (MPa) | % E ASTM | YS/TS | 0.2% YS (MPa) | TS (MPa) | % E ASTM | YS/TS |
| 820-840° C. | 760 | 1123 | 14 | 0.67 | 790 | 1132 | 12 | 0.69 |

As shown by the data, the intercritical anneal temperature range disclosed herein in combination with the ultra fine ferrite-bainite with pearlite starting cold rolled microstructure at CAL and the specific rapid cooling strategies afforded for a cold rolled steel sheet having low alloying costs with exceptional mechanical properties In view of the teaching presented herein, it is to be understood that numerous modifications and variations of the present invention will be readily apparent to those of skill in the art. The foregoing is illustrative of specific embodiments of the invention, but is not meant to be a limitation upon the practice thereof. As such, the scope of the invention is contained with the claims and all equivalents thereof.

We claim:

1. A process for manufacturing a cold rolled dual phase steel comprising:

providing a steel slab having a chemical composition in weight percent within a range of 0.12-0.16 C, 1.6-2.0 Mn, 0.4 max Si, 0.2-0.5 Cr, 0.010 max Nb, 0.030-0.080 Ti, 0.02 max V, 0.04-0.10 Mo, 0.1 max Ni, 0.0040 max S, 0.015 max P, 0.0060 max N, 0.0004-0.0030 B, 0.02-0.05 Al, 0.004 max Ca, balance Fe and melting impurities;

soaking the steel slab within a temperature range of 1200-1300° C.;

hot rolling the soaked steel slab in a roughing treatment and producing a transfer bar;

hot rolling the transfer bar in a finishing treatment and producing hot rolled strip, the finishing treatment having an entry temperature between 1040-1120° C. and an exit temperature between 900-970° C.; and cooling the hot rolled strip to a temperature between 540-620° C.;

coiling the cooled hot rolled strip;

cold rolling the coiled hot rolled strip with at least a 55% reduction in thickness and producing cold rolled sheet;

intercritical annealing the cold rolled sheet at a temperature between 790-840° C.; and rapidly cooling using gas jet cooling and/or ultra rapid cooling using the URC, the intercritically annealed cold rolled sheet to a temperature between 450-500° C., the rapidly cooled sheet having a ferrite plus martensite microstructure.

2. The process of claim 1, wherein the hot rolled and coiled steep strip has a thickness between 2.5 and 5.5 mm.

3. The process of claim 2, wherein the hot rolled strip is cooled to the temperature between 540-620° C. using a cooling rate between 15-40° C./sec.

4. The process of claim 3, wherein the cold rolled sheet is intercritically annealed at the temperature 790-840° C. for a time period between 60-90 seconds.

5. The process of claim 4, wherein the cold rolled and intercritically annealed sheet has a maximum thickness of 2.3 mm.

6. The process of claim 5, wherein the cold rolled and intercritically annealed sheet has a 0.2% yield strength above 550 MPa.

7. The process of claim 6, wherein the cold rolled and intercritically annealed sheet has a tensile strength of at least 980 MPa.

8. The process of claim 7, wherein the cold rolled and intercritically annealed sheet has a total percent elongation to failure of at least 10%.

9. The process of claim 8, wherein the cold rolled and intercritically annealed sheet has a work hardening exponent 'n' of at least 0.06.

10. The process of claim 9, wherein the cold rolled and intercritically annealed sheet has a yield strength to tensile strength ratio (YS/TS) between 0.4-0.7.

11. The process of claim 10, further including bake hardening the cold rolled and intercritically annealed sheet, the bake hardened sheet having an increase in tensile strength of at least 30 MPa.

12. The process of claim 1, wherein the cold rolled and intercritically annealed sheet has a grain size of ASTM 10 or smaller.

13. The process of claim 12, wherein the grain size is ASTM 12 or smaller.

14. A process for manufacturing a cold rolled dual phase steel comprising:

providing a steel slab having a chemical composition in weight percent within a range of 0.12-0.16 C, 1.6-2.0 Mn, 0.4 max Si, 0.2-0.5 Cr, 0.010 max Nb, 0.030-0.080 Ti, 0.02 max V, 0.04-0.10 Mo, 0.1 max Ni, 0.0040 max S, 0.015 max P, 0.0060 max N, 0.0004-0.0030 B, 0.02-0.05 Al, 0.004 max Ca, balance Fe and melting impurities;

soaking the steel slab within a temperature range of 1200-1300° C.;

hot rolling the soaked steel slab in a roughing treatment and producing a transfer bar;

hot rolling the transfer bar in a finishing treatment and producing hot rolled strip, the finishing treatment having an entry temperature between 1040-1120° C. and an exit temperature between 900-970° C.; and cooling the hot rolled strip to a temperature between 540-620° C. using a cooling rate between 15-40° C./sec;

cold rolling the hot rolled strip with at least a 55% reduction in thickness and producing cold rolled sheet;

intercritical annealing the cold rolled sheet at a temperature between 790-840° C. for a time period between 60-90 seconds; and rapidly cooling the intercritically annealed cold rolled sheet using gas jet cooling and/or ultra rapid cooling using the URC to a temperature between 450-500° C., the rapidly cooled sheet having a ferrite plus martensite microstructure with a grain size of ASTM 10 or smaller.

15. The process of claim 14, wherein the cold rolled and intercritically annealed sheet has a 0.2% yield strength between above 550 MPa, a tensile strength of at least 980 MPa and a total percent elongation to failure of at least 10%.

16. The process of claim 15, wherein the cold rolled and intercritically annealed sheet has a work hardening exponent 'n' of at least 0.06 and a yield strength to tensile strength ratio (YS/TS) between 0.4-0.7.

17. The process of claim 16, further including bake hardening the cold rolled and intercritically annealed sheet, the bake hardened sheet having an increase in tensile strength of at least 30 MPa.

* * * * *